US007369803B2

(12) United States Patent
Echigo et al.

(10) Patent No.: US 7,369,803 B2
(45) Date of Patent: May 6, 2008

(54) FIXING DEVICE AND IMAGE FORMING APPARATUS USING THE SAME

(75) Inventors: Katsuhiro Echigo, Asaka (JP); Takashi Fujita, Kanagawa (JP); Shigeo Kurotaka, Kanagawa (JP); Hisashi Kikuchi, Kanagawa (JP); Yukimichi Someya, Saitama (JP); Toshihiko Baba, Kanagawa (JP); Hiroyuki Kunii, Kanagawa (JP); Atsushi Nakafuji, Tokyo (JP); Kohji Ue, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 265 days.

(21) Appl. No.: 11/290,464

(22) Filed: Dec. 1, 2005

(65) Prior Publication Data

US 2006/0140689 A1 Jun. 29, 2006

(30) Foreign Application Priority Data

Dec. 20, 2004 (JP) ..... 2004-368517

(51) Int. Cl.
*G03G 15/20* (2006.01)

(52) U.S. Cl. ..... 399/328; 399/307

(58) Field of Classification Search ..... 399/121, 399/122, 307, 328, 335, 336; 219/216
See application file for complete search history.

(56) References Cited

U.S. PATENT DOCUMENTS 4,430,412 A * 2/1984 Miwa et al. ..... 430/124.1
6,529,701 B2 * 3/2003 Baba et al. ..... 399/307
6,577,836 B2 * 6/2003 Yamashita et al. ..... 399/307
6,604,461 B1 * 8/2003 De Bock et al. ..... 101/211
6,957,036 B2 10/2005 Kikuchi et al.
6,999,710 B2 * 2/2006 Kasahara ..... 399/329
7,031,648 B2 * 4/2006 Takashi et al. ..... 399/307
7,127,202 B2 * 10/2006 Fujita et al. ..... 399/307
2004/0037595 A1 2/2004 Takashi et al.
2005/0025534 A1 2/2005 Fujita et al.
2005/0152721 A1 7/2005 Kikuchi et al.
2005/0158075 A1 7/2005 Echigo et al.

(Continued)

FOREIGN PATENT DOCUMENTS

JP 59-19976 2/1984

(Continued)

OTHER PUBLICATIONS

U.S. Appl No. 11/757,150, filed Jun. 1, 2007, Seto et al.

(Continued)

*Primary Examiner*—Hoan Tran
(74) *Attorney, Agent, or Firm*—Oblon, Spivak, McClelland, Maier & Neustadt, P.C.

(57) ABSTRACT

A fixing device for fixing image information on a recording medium passing a nip of the present invention includes a rotatable member for transferring and conveying a non-fixed image, a first heating means for heating an image present on the rotatable member and a rotatable pressing member forming a nip in combination with the rotatable member. A heat pipe extends in parallel to the axis of the rotatable member. A radiating member is positioned at one end of the heat pipe while a heating member is positioned at the other end of the heat pipe.

6 Claims, 5 Drawing Sheets

U.S. PATENT DOCUMENTS

| | | | |
|---|---|---|---|
| 2005/0207801 | A1 | 9/2005 | Kunii et al. |
| 2006/0140689 | A1 | 6/2006 | Echigo et al. |

FOREIGN PATENT DOCUMENTS

| | | |
|---|---|---|
| JP | 60-254071 | 12/1985 |
| JP | 8-137277 | 5/1996 |
| JP | 2000-29341 | 1/2000 |
| JP | 2001-201978 | 7/2001 |
| JP | 2002-55552 | 2/2002 |
| JP | 2002-244450 | 8/2002 |
| JP | 2004-86091 | 3/2004 |

OTHER PUBLICATIONS

U.S. Appl. No. 11/681,739, filed Mar. 2, 2007, Seto et al.
U.S. Appl. No. 11/683,086, filed Mar. 7, 2007, Takemoto et al.
U.S. Appl. No. 11/669,817, filed Jan. 31, 2007, Suzuki et al.
U.S. Appl. No. 11/521,494, filed Sep. 15, 2006, Takagaki et al.

* cited by examiner

FIXING DEVICE AND IMAGE FORMING APPARATUS USING THE SAME

BACKGROUND OF THE INVENTION

1. Field of the Invention

The present invention relates to a fixing device for use in a copier, printer, facsimile apparatus or similar image forming apparatus and more particularly to a transfixing type of fixing device configured to melt with heat a toner image transferred to a fixing roller at a secondary image transferring position and then transfer and fix the toner image to a sheet or recording medium by tertiary image transfer.

2. Description of the Background Art

A transfixing type of fixing device directly heats a toner image transferred to a fixing roller with a radiation source and a reflector substantially surrounding the radiation source. In this type of fixing device, when a toner image is transferred to the fixing roller, toner is directly heated by radiant heat in part of the fixing roller where the toner image is present while the surface of the fixing roller is directly heated in the other part where the toner image is absent. This brings about a problem that the temperature of the fixing roller becomes irregular along the image pattern after the toner image has been fixed on the sheet. As a result, when the next toner image is transferred to the fixing roller at the secondary image transfer position, the irregularity in temperature, corresponding to the previous image pattern, is likely to remain as a temperature history and effect the above toner image. Image defects include, e.g., irregularities in gloss and fixation and granularity.

A conventional fixing system applicable to an image forming apparatus fixes a toner image on a recording medium by heating and pressing the toner image. It is a common practice with such a fixing system to fix a toner image on a recording medium by melting the toner image with heat radiated from a halogen lamp or causing a heat-resistant film including a thin metallic layer or conductor to contact a recording medium implemented as an endless belt or a hollow cylinder. In any case, however, a fixing device generates a considerable amount of thermal energy which is likely to effect various units around the fixing device.

On the other hand, a heat pipe is capable of rapidly transporting, despite a small temperature difference, a great amount of thermal energy by use of latent heat derived from evaporation or condensation. A heat pipe is a heat conduction device in which a small amount of working liquid is sealed and having thermal conductivity several hundred times as high as the conductivity of copper, which is originally high.

Japanese patent laid-open publication Nos. 59-019976, 08-137277 and 2004-086091, for example, each disclose a particular image forming apparatus using a heat pipe as cooling means for protecting image forming sections other than heating means from heat output from the heating means. On the other hand, Japanese patent laid-open publication Nos. 60-154071 and 2000-29341, for example, propose to use a heat pipe as a fixing roller itself in order to reduce a warm-up time in combination with an induction heating effect, thereby realizing an on-demand fixing system that heats a fixing device only during intervals between consecutive printing.

Further, paying attention to the extremely high thermal conductivity of a heat pipe, Japanese patent laid-open publication No. 2001-201978, for example, proposes to use a heat pipe as a heat diffusing member for preventing, in a continuous print mode, heat from rising in the zones of a fixation nip outside of a sheet passing zone. Likewise, Japanese patent laid-open publication No. 2002-244450 proposes to use a heat pipe as temperature uniforming means for obviating temperature differences between a sheet passing portion and portions outside of the same.

Moreover, Japanese patent laid-open publication No. 2002-055552 teaches a fixing device of the type using a heat-resistant film whose thermal capacity is small and configured to reduce the irregular temperature distribution of the film in the widthwise direction. For this configuration, a heat pipe is included in a temperature irregularity reducing member positioned outside of a second roller body.

SUMMARY OF THE INVENTION

It is an object of the present invention to provide a fixing device capable of reducing a warm-up time and obviating irregularity in temperature ascribable to the image history of the previous image forming step occurring on a fixing member as well as irregularity in temperature in the lengthwise direction ascribable to the continuous feed of sheets of a relatively small size.

A fixing device for fixing image information on a recording medium passing a nip of the present invention includes a rotatable member for transferring and conveying a non-fixed image, a first heating means for heating an image present on the rotatable member and a rotatable pressing member forming a nip in combination with the rotatable member. A heat pipe extends in parallel to the axis of the rotatable member. A radiating member is positioned at one end of the heat pipe while a heating member is positioned at the other end of the heat pipe.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
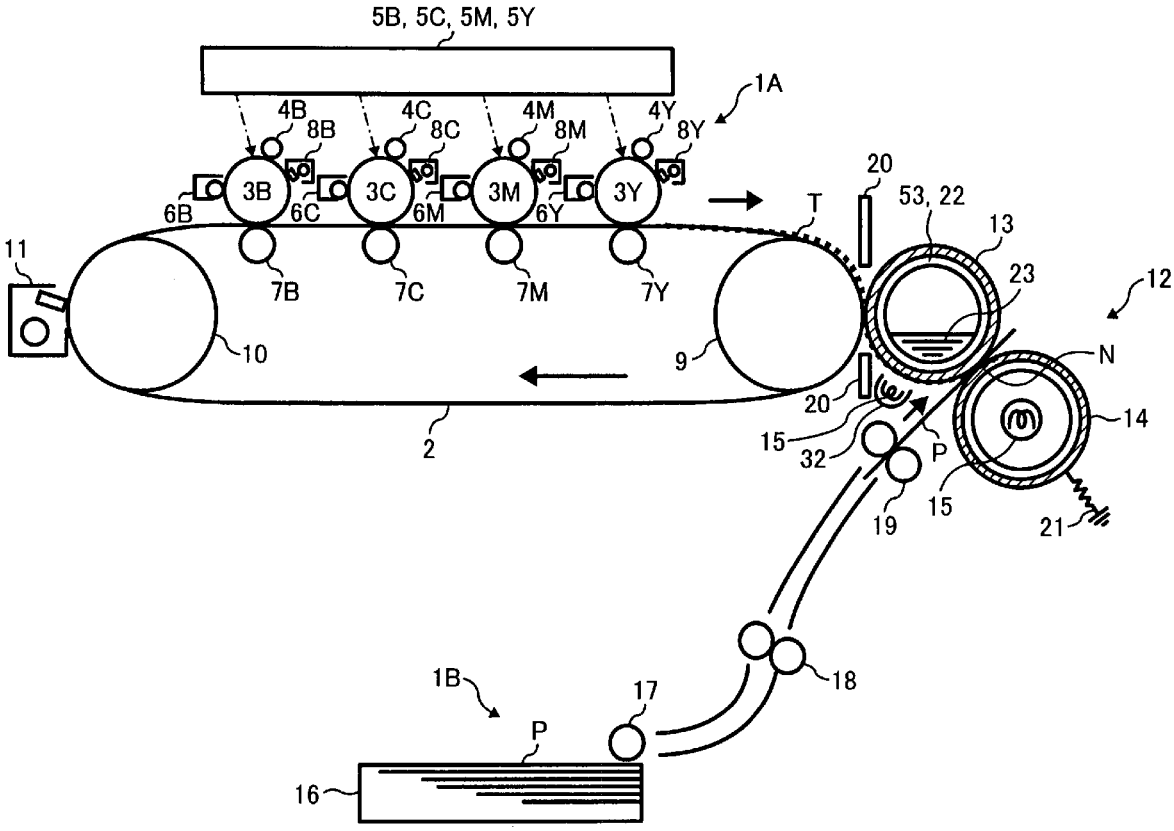
FIG. 1 is a view showing the general construction of an image forming apparatus to which the present invention is applied.

Referring to FIG. 1 of the drawings, an image forming apparatus to which the present invention is applied is shown and implemented as a tandem color copier by way of example. As shown, the color copier, generally 1, includes an image forming section 1A arranged at the center of the copier body, a sheet feeding section 1B positioned below the image forming section 1A and an image scanning section, not shown, positioned above the image forming section 1A.

The image forming section 1A includes an intermediate image transfer belt 2, which is a specific form of an intermediate image transfer body. An arrangement for forming images of colors complementary to separated colors is positioned on the upper run or image transfer surface of the intermediate image transfer belt (simply belt hereinafter) 2.

More specifically, photoconductive elements or image carriers 3Y, 3M, 3C and 3B are arranged side by side along the image transfer surface of the belt 2 for carrying toner images of complementary colors, i.e., yellow, magenta, cyan and black, respectively. An optical writing unit or means 5 (5Y, 5M, 5C and 5B) is located above the photoconductive elements 4Y through 4B.

In the illustrative embodiment, the photoconductive elements 3Y through 3B are implemented as drums rotatable in the same direction, i.e., counterclockwise in FIG. 1. Arranged around the drums 3Y, 3M, 3C and 3B are chargers 4Y, 4M, 4C and 4B, developing devices 6Y, 6M, 6C and 6B and drum cleaners. 8Y, 8M, 8C and 8B, respectively. Primary image transferring devices 7Y, 7M, 7C and 7B respectively face the drums 3Y, 3M, 3C and 3B with the intermediary of the belt 2. It is to be noted that the suffices Y, M, C and B correspond to the colors of toners stored in the developing devices 6Y, 6M, 6C and 6Y, respectively. The belt 2 is passed over a drive roller 9 and a driven roller 10 and rotatable clockwise, as indicated by an arrow in FIG. 1. A belt cleaner 11 is located to face the driven roller 10 with the intermediary of the belt 2 so as to clean the surface of the belt 2.

In operation, the charger 4Y uniformly charges the surface of the drum 3Y. The optical writing unit 5 scans the charged surface of the drum 3Y with a light beam in accordance image data to thereby form a latent image on the drum 3Y. Subsequently, the developing device 7Y, applied with a preselected bias for development, develops the latent image with yellow toner for thereby producing a yellow toner image. The yellow toner image thus formed is transferred from the drum 3Y to the belt 2 by the primary image transferring device 7Y also applied with a preselected bias. Such a sequence of steps are executed with the other drums 3M 3C and 3Y also except for the color of toner. As a result, toner images of different colors are sequentially transferred to the belt 2 one above the other, completing a full-color toner image or non-fixed image on the belt 2. The toners left on the drums 3Y through 3B after the primary image transfer are removed by the drum cleaners 8Y through 8B, respectively. Further, the drums 3Y through 3B thus cleaned are discharged by quenching lamps, not shown, and prepared for the next image formation thereby.

The sheet feeding section 1B includes a sheet tray 16 loaded with a stack of sheets or recording media P. A pickup roller 17 pays out the top sheet P from the sheet tray 16 toward a registration roller pair 19 while separating it from the underlying sheets P. The registration roller pair 19 once stops the sheet P to correct a skew and again drives the sheet P toward a nip N such that a preselected position of the sheet P in the direction of conveyance meets the leading edge of the full-color toner image transferred to an image transferring and fixing roller 13.

More specifically, a fixing device 12 is positioned in the vicinity of the drive roller 9 and includes a press roller or rotatable pressing member 14 in addition to the image transferring and fixing roller or rotatable member 13. The press roller 14 is pressed against the image transferring and fixing roller 13 by a spring or biasing means, so that the nip N is formed between the two rollers 13 and 14.

The full-color toner image, labeled T in FIG. 1, completed on the belt 2 is transferred from the belt 2 to the image transferring and fixing roller 13 by an electrostatic force derived from a bias applied to the drive roller 9 by secondary image transferring means not shown. The bias may be a DC bias or an AC-biased DC bias by way of example. The toner image T will sometimes be referred to as toner or toner particles hereinafter, as the case may be.

As shown in FIG. 1, a heat insulation plate 20 is interposed between the belt 2 and the image transferring and fixing roller 13 and plays the role of a heat screening member or heat transfer control member for controlling the heat radiation or heat transfer from the roller 13 to the belt 2. The heat insulation plate 20, which may be mounted on either one of the fixing device body and the copier body, is formed with an opening so as to reduce heat radiation to the belt 2 without obstructing the secondary image transfer from the belt 2 to the image transferring and fixing roller 13.

The heat transfer control member 20 should preferably be implemented as a glossy plate with a low radiation ratio, more preferably two metallic sheets positioned at opposite sides of a small gap or an insulator. Further, use may be made of a thin plate having a microheat pipe structure used to cool a CPU (Central Processing Unit) mounted on a notebook size personal computer, in which case the heat transfer control member can be held at low temperature for controlling heat transfer at a high level. With the heat insulation plate 20, it is possible to reduce temperature elevation of the belt or intermediate image transfer body 2 to a certain degree and therefore to control the thermal deterioration of the belt 2.

The image transferring and fixing roller 13 and press roller 14 each are implemented by a hollow cylindrical core 53 formed of aluminum or similar metal and coated with a 0.05 mm to 0.5 mm thick elastic layer and a 10 μm to 30 μm thick parting layer formed of PFA (perfluoroalcoxy), PTFE (polytetrafluoroethylene) or similar fluorine-based resin. If desired, the elastic layer and parting layer may be implemented as a tube fitted on the core 53. Halogen heaters or heating means 15 are disposed in the vicinity of the surface of the image transferring and fixing roller 13 and the inside of the press roller 14 in order to heat toner present on the surfaces of the rollers 13 and 14. The outside diameter of the image transferring and fixing roller 13 is selected to be great enough to cover the length of a single sheet P or above because the roller 13 has to hold an image extending over the length of the sheet P.

Further, the surface temperature of the image transferring and fixing roller 13 and that of the press roller or second transferring and fixing roller 14 are sensed by a respective thermistor, not shown, each positioned in a non-image zone. A temperature controller, not shown, controls each of the halogen heaters 15 on or off in accordance with the above surface temperatures.

If desired, the parting layer of each of the image transferring and fixing roller 13 and press roller 14 may be implemented by conductive fluorine-based resin in which carbon or similar conductive substance is dispersed and connected to the core 53 thereby. Such an alternative structure allows an image transfer bias to be applied between the two parting layers, allowing the image transfer bias to be lowered and reducing toner scattering at the time of image transfer.

Figure 2:
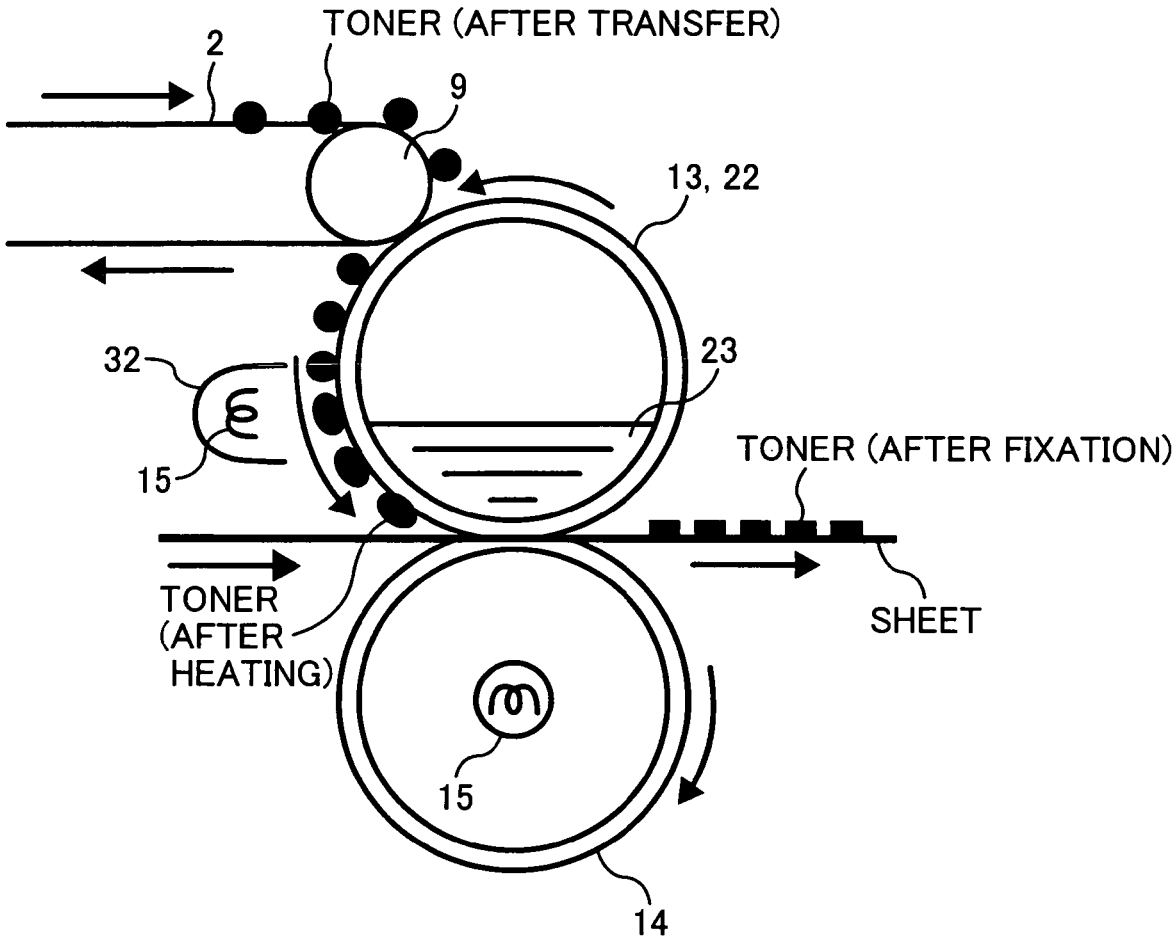
FIG. 2 is a view showing a fixing device embodying the present invention included in the apparatus of FIG. 1.
Figure 3:
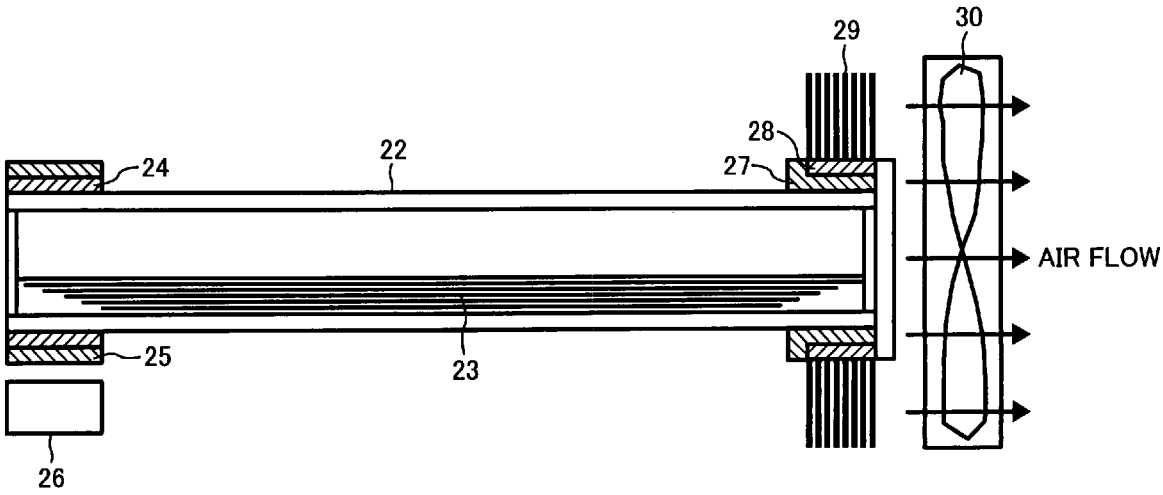
FIG. 3 is a view showing the configuration of a heat pipe.

Reference will be made to FIGS. 2 and 3 for describing a preferred embodiment of the fixing device in accordance with the present invention. As shown in FIG. 2, the toner image T carried on the belt 2 is transferred to the image transferring and fixing roller 13 with the drive roller 9 and roller 13 being held in contact with each other or spaced from each other by a small gap. Radiation energy, emitted from the halogen heater 15 adjoining the image transferring and fixing roller 13, is condensed by a reflector 32 to heat the toner image present on the roller 13, making the toner image half-melted.

After the switch-on of the printer body, but before the start of a printing step, the surface temperature of the image transferring and fixing roller 13 is controlled to a preselected temperature by the halogen heaters 15 associated with the roller 13 and press roller 14 as well as by induction heating, which will be described specifically later. The surface temperature of the image transferring and fixing roller 13 is controlled to 100° C. or below, preferably to about 80° C., so as to protect the belt 2 from excessive load.

At the stat of a printing step, the halogen heater 15 disposed in the press roller 14 and an induction coil, which will be described later, are turned off while power is fed to the halogen heater 15 substantially surrounded by the reflector 32. Just after the toner image has been moved away from a copying region where the reflector 32 and halogen heater 15 are present, the temperature distribution in the toner layer is higher at the side facing the halogen heater 15, i.e., the side expected to face the sheet P than at the side contacting the image transferring and fixing roller 13. More specifically, while part of the temperature of the toner layer contacting the image transferring and fixing roller 13 is about 80° C., as stated earlier, part of the same facing the halogen heater 15 needs a temperature high enough to be sufficiently strongly fixed on the sheet P, which is higher than 80° C.

We found that the temperature of the interface between a toner image and a sheet or recording medium high enough to implement sufficient fixing strength was about 110° C. to about 120° C. Moreover, it is apparent that because the temperature of toner particles far smaller in thermal capacity than a recording medium is sharply lowered on contacting a recording medium, the fixing step cannot be completed at the outlet of a nip for fixation unless the toner temperature is raised at the inlet of the nip. For example, assuming that the toner is heated to about 150° C. by radiation when moved away from the reflector 32, then even the portions of the surface of the image transferring and fixing roller 13 where the toner image is absent directly receives radiation energy and is heated thereby.

The surface of the transferring and fixing roller 13 is colored in black so as to increase the radiation energy absorption ratio at the time of startup. As a result, the interface between the toner particles and the image transferring and fixing roller 13 has heretofore been lower than the surface temperature of the roller 13 directly receiving the radiation energy, i.e., the surface temperature of the roller 13 has become irregular in the pattern of the toner image. The irregularity in temperature has remained on the image transferring and fixing roller 13 even after the toner image has been transferred to a recording medium at the nip.

In the illustrative embodiment, the image transferring and fixing roller 13 is implemented by a heat pipe 22 in order to reduce the irregularity in temperature stated above as far as possible. More specifically, a working liquid 23 sealed in the heat pipe 22 uniforms the temperature distribution in the lengthwise direction of the image transferring and fixing roller 13 for thereby obviating the irregularity in temperature. It follows that even when another toner image pattern is transferred from the belt 2 to the image transferring and fixing roller 13, the history of the previous toner image pattern is not left on the roller 13, so that a high-quality toner image free from irregularity in fixation and irregular gloss and other image defects is achievable.

As shown in FIG. 3, a radiator 29 is held in contact with one end of the heat pipe 22 while fins 29 are positioned around the radiator 27 and formed of aluminum or similar metal with high thermal conductivity. At the time of startup, the heat pipe 22 is rotated while the fins 29 are held stationary, i.e., the heat pipe 22 idles at connecting portions. When a solenoid-operated clutch 28 is energized, the fins 29 start rotating together with the heat pipe 22.

Positioned at the other end of the heat pipe 22 is a heating device made up of a heat generating layer 25, a heat insulating layer 24 and an induction coil 26. More specifically, the heating device includes a planar heating body adhered to the end of the heat pipe 22 and generating heat when a current is fed thereto or includes a metallic layer of, e.g., Ag formed on the above end and the induction coil 26 for induction heating. At the time of startup, the heating device with such a configuration generates heat in addition to heat generated by the halogen heater 15 and reflector 32 with the result that heat is rapidly transferred by the heat pipe 22 to thereby noticeably reduce the warm-up time. After the surface of the image transferring and fixing roller 13 has been heated to a preselected temperature, the heating device is turned off to operate as a usual heat pipe.

When image patterns noticeably different in the area of a solid image from each other are continuously passed or when sheets of relatively small size are continuously passed, the fins 29 are rotated together with the heat pipe 22 via the solenoid-operated clutch 28 in the same manner as stated above. In addition, a fan 30, positioned at one side of the fins 29, is rotated to produce an air flow in a direction indicated by arrows in FIG. 3, allowing the temperature to be rapidly uniformed in the lengthwise direction.

Figure 4:
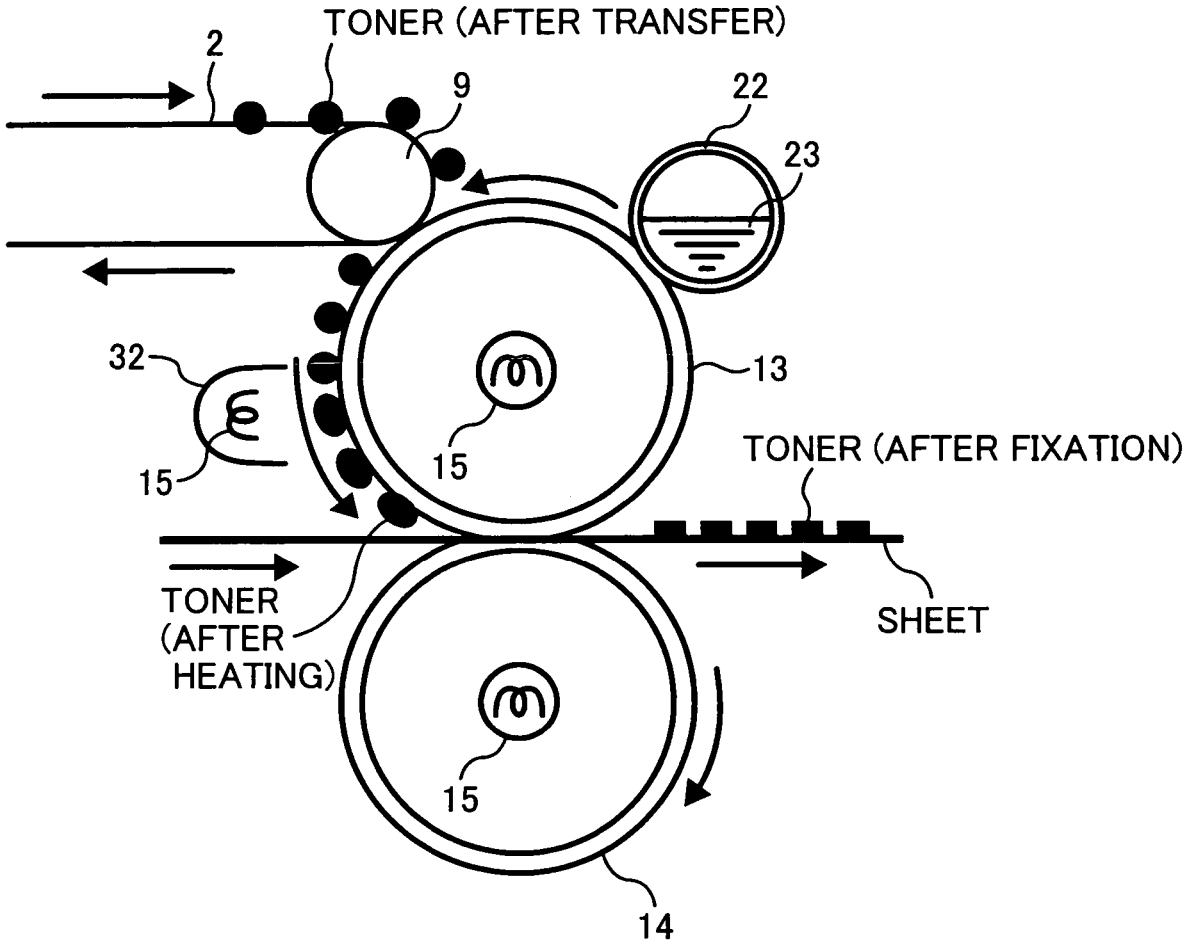
FIG. 4 is a view showing an alternative embodiment of the present invention.

An alternative embodiment of the fixing device in accordance with the present invention will be described with reference to FIG. 4. As shown, this embodiment is identical with the previous embodiment except that the heat pipe 22 is held in contact with the outer periphery of the transferring and fixing roller 13. The structure of the heat pipe 22 itself is identical with the structure shown in FIG. 3. Structural elements identical with the structural elements of the previous embodiment are designated by identical reference numerals, and detailed description thereof will not be made in order to avoid redundancy.

In the illustrative embodiment, a halogen heater 15 is disposed in the image transferring and fixing roller 13 also. The three halogen heaters 15 in total further reduce the warm-up time in cooperation with induction heating. In a fixing step that begins after the surface of the image transferring and fixing roller 13 has reached the preselected temperature, only the halogen heater 15 substantially surrounded by the reflector 32 continuously heats the toner and image transferring and fixing roller 13. Although irregularity in temperature may occur after the fixation of the toner image T on the sheet P as in the previous embodiment, the illustrative embodiment causes the heat pipe 22 held in contact with the image transferring and fixing roller 13 to rotate before the roller 13 again contacts the belt 2. This successfully obviates the above irregularity because of the effect of the working liquid 23.

In the illustrative embodiment, the heat pipe 22, contacting the image transferring and fixing roller 13, may be implemented as a cleaning roller, in which case the surface of the cleaning roller is formed of a material lower in parting ability than the surface of the roller 13. With this configuration, it is possible to remove toner particles left on the image transferring and fixing roller 13 after the image transfer for thereby insuring desirable images free from smears.

Figure 5:
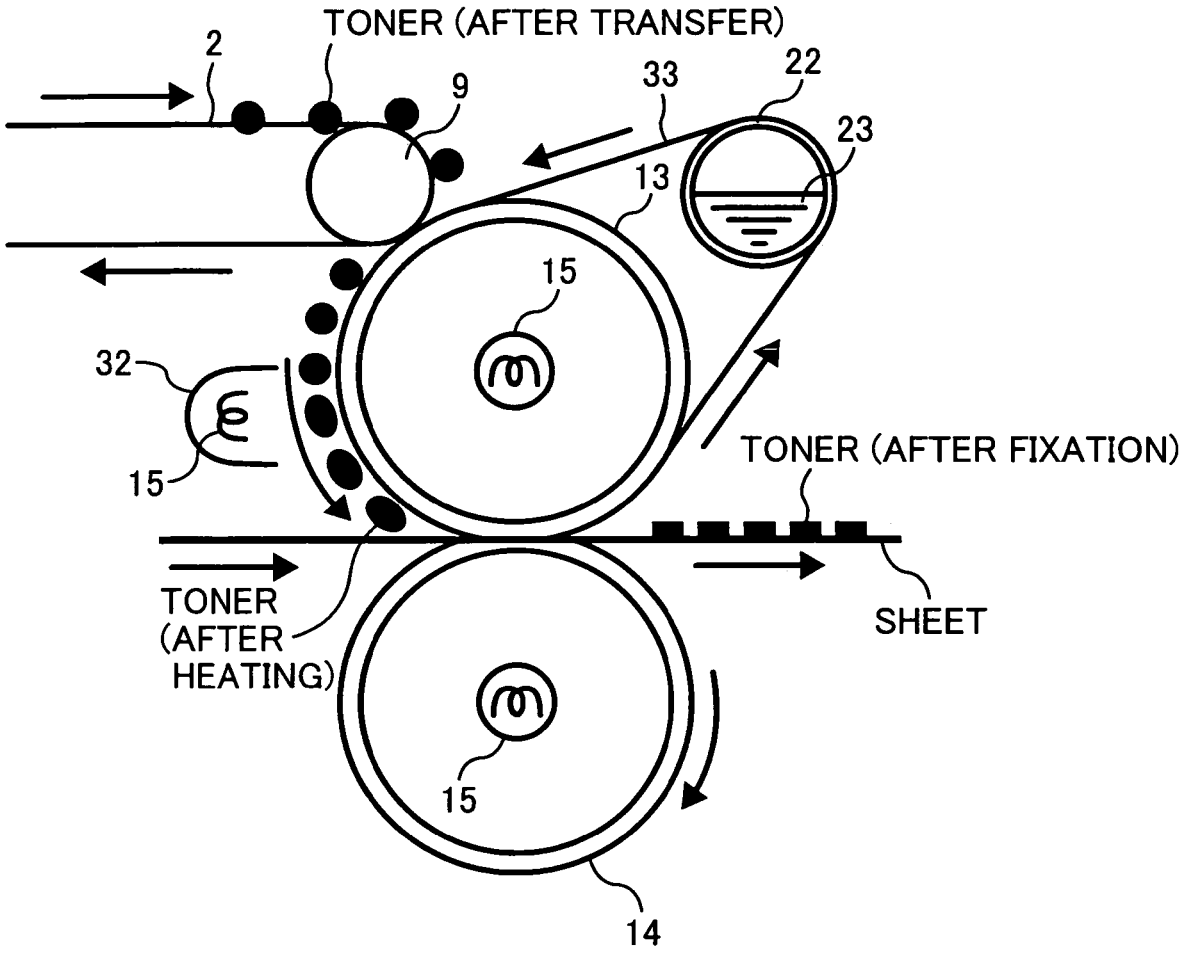
FIG. 5 is a view showing another alternative embodiment of the present invention.

FIG. 5 shows another alternative embodiment of the fixing device in accordance with the present invention. This embodiment differs from the previous embodiments in that the image transferring and fixing member is implemented by an image transferring and fixing belt 33 passed over the fixing roller 13 and heat pipe 22. In this configuration, the toner image T is transferred from the belt 2 to the image transferring and fixing belt 33. The structure of the heat pipe 22 itself is identical with the structure shown in FIG. 3. Structural elements identical with the structural elements of the embodiment described first are designated by identical reference numerals, and detailed description thereof will not be made in order to avoid redundancy.

In the illustrative embodiment, too, a halogen heater 15 is disposed in the fixing roller 13 also. The three halogen heaters 15 in total further reduce the warm-up time in cooperation with induction heating. In a fixing step that begins after the surface of the image transferring and and fixing belt 13 has reached the preselected temperature, only the halogen heater 15 substantially surrounded by the reflector 32 continuously heats the toner and belt 13. Although irregularity in temperature may occur on the transferring and fixing belt 33 after the fixation of the toner image T on the sheet P as in the previous embodiments, the illustrative embodiment causes the heat pipe 22 held in contact with the image transferring and fixing belt 13 to rotate before the belt 13 again contacts the belt 2. This successfully obviates the above irregularity because of the effect of the working liquid 23. The illustrative embodiment is advantageous over the previous embodiments in that a sufficient period of time is available between the nip and the position where the image transferring and fixing belt 3 again contacts the belt 2 and further uniforms temperature.

In summary, it will be seen that the present invention provides a fixing device achieving a short warm-up time and obviating irregularity in temperature ascribable to the image history of the previous image forming step left on a fixing member and irregularity in temperature in the lengthwise direction ascribable to the continuous feed of sheets of relatively small size.

Various modifications will become possible for those skilled in the art after receiving the teachings of the present disclosure without departing from the scope thereof.

What is claimed is:

1. A fixing device for fixing image information on a recording medium passing a nip, said fixing device comprising:

a rotatable member for transferring and conveying a non-fixed image;

a first heating means for heating an image present on said rotatable member;

a rotatable pressing member forming a nip in combination with said rotatable member;

a heat pipe extending in parallel to an axis of said rotatable member;

a radiating member positioned at one end of said heat pipe; and a heating member positioned at the other end of said heat pipe.

2. The fixing device as claimed in claim 1, wherein said heat pipe constitutes said rotatatable member.

3. The fixing device as claimed in claim 1, wherein said heat pipe is rotatable in contact with said rotatable member in an axial direction.

4. The fixing member as claimed in claim 3, wherein said heat pipe bifunctions as a cleaning roller.

5. The fixing member as claimed in claim 1, wherein said rotatable member comprises an endless belt passed over a plurality of roller members at least one of which is constituted by said heat pipe.

6. An image forming apparatus including a fixing device for fixing image information on a recording medium passing a nip, said fixing device comprising:

a rotatable member for transferring and conveying a non-fixed image;

a first heating means for heating an image present on said rotatable member;

a rotatable pressing member forming a nip in combination with said rotatable member;

a heat pipe extending in parallel to an axis of said rotatable member;

a radiating member positioned at one end of said heat pipe; and a heating member positioned at the other end of said heat pipe.

* * * * *